US009995033B2

(12) United States Patent
Becker et al.

(10) Patent No.: US 9,995,033 B2
(45) **Date of Patent: *Jun. 12, 2018**

(54) WASTEWATER-LIFTING SYSTEM

(71) Applicant: KSB Aktiengesellschaft, Frankenthal (DE)

(72) Inventors: Michael Becker, Frankenthal (DE); Enrico Mueller, Frankenthal (DE); Thomas Pensler, Frankenthal (DE); Maik Ulmschneider, Frankenthal (DE)

(73) Assignee: KSB Aktiengesellschaft, Frankenthal (DK)

( * ) Notice: Subject to any disclaimer, the term of this patent is extended or adjusted under 35 U.S.C. 154(b) by 47 days.

This patent is subject to a terminal disclaimer.

(21) Appl. No.: 15/029,843

(22) PCT Filed: Oct. 10, 2014

(86) PCT No.: PCT/EP2014/071728

§ 371 (c)(1),
(2) Date: Apr. 15, 2016

(87) PCT Pub. No.: WO2015/055520

PCT Pub. Date: Apr. 23, 2015

(65) Prior Publication Data

US 2016/0237672 A1 Aug. 18, 2016

(30) Foreign Application Priority Data

Oct. 17, 2013 (DE) ..... 10 2013 221 080

(51) Int. Cl.
*E03F 5/22* (2006.01)
*E03F 5/10* (2006.01)

(52) U.S. Cl.
CPC . *E03F 5/22* (2013.01); *E03F 5/10* (2013.01)

(58) Field of Classification Search
CPC ..... E03F 5/10; E03F 5/22; E03F 7/00
(Continued)

(56) References Cited

U.S. PATENT DOCUMENTS 3,375,788 A * 4/1968 Solas ..... E03F 5/22 137/364
3,730,884 A * 5/1973 Burns ..... E03F 1/006 210/170.08

(Continued)

FOREIGN PATENT DOCUMENTS

DE 295 05 028 U1 7/1995
EP 1 108 822 A1 6/2001

(Continued)

OTHER PUBLICATIONS

Machine translation of EP 1 108 822, Jun. 2001.*

(Continued)

*Primary Examiner* — Christopher Upton
(74) *Attorney, Agent, or Firm* — Crowell & Moring LLP

(57) ABSTRACT

A wastewater-lifting system is provided. The wastewater-lifting system includes at least one bulky-material-collecting vessel for wastewater loaded with bulky materials which is guided therethrough, a liquid-collecting vessel for the wastewater which is freed from bulky materials and precleaned in the bulky-material-collecting vessel, and with a wastewater shaft for accommodating the bulky-material-collecting vessel and the liquid-collecting vessel. The liquid-collecting vessel and the wastewater shaft have at least one common wall surface. The liquid-collecting vessel defines a closed-off space with only a partially covered base surface in the wastewater shaft, and is equipped for this purpose with at least one wall surface independent of the wastewater shaft.

10 Claims, 4 Drawing Sheets

(58) Field of Classification Search
USPC ..... 210/170.01, 170.03, 170.08, 416.1; 137/363
See application file for complete search history.

(56) References Cited

U.S. PATENT DOCUMENTS

| | | | | | |
|---|---|---|---|---|---|
| 4,594,153 | A * | 6/1986 | Weis | E03F 5/22 | 210/170.08 |
| 5,013,457 | A * | 5/1991 | Mims | B01D 29/114 | 210/416.1 |
| 5,433,854 | A * | 7/1995 | Dickerson | C02F 1/78 | 210/170.08 |
| 5,543,064 | A * | 8/1996 | Batten | E03F 5/22 | 210/532.1 |
| 8,561,633 | B2 * | 10/2013 | Early | E03B 3/03 | 210/170.03 |
| 2016/0265210 | A1 * | 9/2016 | Becker | E03F 5/22 | |

FOREIGN PATENT DOCUMENTS

| | | | |
|---|---|---|---|
| JP | 2004-124582 | A | 4/2004 |
| WO | WO 2013/119130 | A1 | 8/2013 |

OTHER PUBLICATIONS

Machine translation of JP 2004-124582, Apr. 2004.*
English translation of Chinese Office Action issued in counterpart Chinese Application No. 201480056955.7 dated Dec. 9, 2016 (four pages).
International Search Report (PCT/ISA/210) issued in PCT Application No. PCT/EP2014/071728 dated Dec. 15, 2014, with English translation (four (4) pages).
German-language Written Opinion (PCT/ISA?237) issued in PCT Application No. PCT/EP2014/071728 dated Dec. 15, 2014 (seven (7) pages).
German Search Report issued in counterpart German Application No. 10 2013 221 080.9 dated Jun. 16, 2014, with partial English translation (twelve (12) pages).
International Preliminary Report on Patentability (PCT/IB/373) issued in PCT Application No. PCT/EP2014/071728 dated Apr. 19, 2015, including English translation of document C2 (German-language Written Opinion (PCT/ISA/237)) previously filed on Apr. 15, 2016 (10 pages).

* cited by examiner

WASTEWATER-LIFTING SYSTEM

CROSS REFERENCE TO RELATED APPLICATIONS

This application is a National Phase of PCT International Application No. PCT/EP2014/071728, filed Oct. 10, 2014, which claims priority under 35 U.S.C. § 119 from German Patent Application No. 10 2013 221 080.9, filed Oct. 17, 2013, the entire disclosures of which are herein expressly incorporated by reference.

BACKGROUND AND SUMMARY OF THE INVENTION

The invention relates to a wastewater pumping station, having at least one solids collecting tank for wastewater which is guided through the same and is loaded with solids, additionally having a liquid collecting tank for the wastewater which has been rid of solids and has been pretreated in the solids collecting tank and having a wastewater shaft for receiving at least the solids collecting tank and the liquid collecting tank, wherein the liquid collecting tank and the wastewater shaft comprise at least one common wall surface.

As is known, wastewater pumping stations are typically utilized for the purpose of pumping wastewater, which has collected at the bottom of a wastewater storage chamber, up to a certain level. After this, further treatment is then effected in the majority of cases in a wastewater treatment plant. In the past and in the prior art, the wastewater is frequently pumped using large, inefficient pumps.

For this reason, the generic teaching according to European patent document no. EP 1 108 822 A1 describes a wastewater pumping station where raw solids or solids are separated from the conveying medium, as a rule the wastewater, before said wastewater enters into a pump that is used. A solids collecting tank which is connected upstream of the pump takes care of the described separation. The solids are ideally held back in the solids collecting tank such that wastewater that has been pretreated once is transferred into a liquid collecting tank which is connected downstream of the solids collecting tank.

The wastewater pumping stations used in practice are typically received and placed in a wastewater shaft which is produced from concrete. The possibility of the liquid collecting tank and the wastewater shaft which receives the wastewater pumping station being produced from plastics material is described over and above this within the framework of generic European patent document no. EP 1 108 822 A1. In this case, the shaft bottom simultaneously forms the bottom of the liquid collecting tank.

German patent document no. DE 295 05 028 U1, which is also generic, proceeds in a similar manner. In this case, a center wall in the wastewater shaft and part of the shaft wall form the liquid collecting tank. The shaft wall and the center wall or all remaining walls are produced from plastics material in the sense of a structural bond. Costs and installation space are to be saved as a result.

The known measures are not without problems. For a wastewater shaft which is produced, for example, from concrete has first of all to be established and constructed on site. As a rule, the wastewater pumping station is then installed after that. In this case, a liquid collecting tank, which is produced from metal or plastics material, is chosen in practice for the most part. Said liquid collecting tank is designed in a separate and independent manner from the wastewater shaft and is received in the wastewater shaft in question.

In the case of the teaching according to European patent document no. EP 1 108 822 A1, the liquid collecting tank and the wastewater shaft are produced from plastics material, the shaft bottom simultaneously forming the bottom of the liquid collecting tank. As a result, the installation site of the liquid collecting tank in the wastewater shaft is restricted. In addition, there is no longer additional installation space available on the bottom. More significant, however, is the choice of material (plastics material). Wastewater shafts produced from plastics material are certainly able to be industrially prefabricated and cost advantages result from this (cf. German patent document no. DE 295 05 028 U1). However, these types of structures frequently cannot always cope or cannot always cope in the long term with the static and dynamic loads at the installation site. The invention aims to create a remedy here overall.

The technical problem underlying the invention is to develop further a wastewater pumping station of this type such that long-term operation is ensured and at the same time cost advantages during production are seen.

To solve said technical problem, a generic wastewater pumping station within the framework of the invention is characterized in that the liquid collecting tank defines a closed chamber in the wastewater shaft with an only partially covered bottom area and to this end is provided with at least one wall surface which is independent of the wastewater shaft and is of different material.

In the first instance, a liquid collecting tank, which defines a closed chamber in the wastewater shaft, is realized within the framework of the invention, that is to say has a bottom, side walls and a head-end cover. As the liquid collecting tank in question only covers the floor area in the wastewater shaft or of the wastewater shaft in a partial manner, there is an installation area or a space for structures available on the floor area of the wastewater shaft which is not taken up by the liquid collecting tank.

Said installation area or space can be utilized, for example, for mounting one or several pumps at that location. The relevant pump, in this case, is assigned to the solids collecting tank and serves for emptying the liquid collecting tank via the solids collecting tank in question. At any rate, the pump in question (where applicable in connection with further elements of the wastewater pumping station) is able to be mounted and placed dry in the space already addressed which is available in the wastewater shaft because the liquid collecting tank only covers part of the floor area of the wastewater shaft.

Not only the installation of the one or the several pumps is facilitated in this way, but maintenance of the pump is also able to be realized and implemented during operation. In the same way, the available installation area or space can also be utilized for mounting and placing a distributor casing or a distributor which guides and conducts the wastewater, which is loaded with the solids, to the solids collecting tank. Coarse solids can be separated from the wastewater in the distributor casing.

In any case, it is possible within the framework of the invention to accommodate the distributor casing in the space addressed such that the installation and the maintenance as well as the accessibility are facilitated. The same applies to the solids collecting tank. In said context, it ought to be stressed that the space is realized not only next to the liquid collecting tank on the bottom surface of the wastewater shaft that is not covered by the liquid collecting tank, but the space can also extend further in the wastewater shaft above the head-end cover of the liquid collecting tank. A particularly compact design and in particular a reduced shaft diameter is seen as a result.

In said context, the invention provides that the head-end cover in question is designed so as to be removable where applicable. As a result, possible maintenance work is made even easier. By designing the cover or the wall surface that is independent of the wastewater shaft in different materials compared to the wastewater shaft, it is possible to design the wastewater shaft in a dense manner from, for example, concrete, whereas the wall surfaces of the liquid collecting tank which are independent of the wastewater shaft can be produced typically from plastics material or metal. Said mixture of materials combines significant stability of the wastewater shaft and of the liquid collecting tank with particular cost advantages.

Apart from this, the liquid collecting tank can be provided with an inspection opening which can be removed or rather opened for maintenance purposes or also for checking the liquid collecting tank. The liquid collecting tank can be checked and also cleaned in this way where necessary.

Over and above this, the liquid collecting tank may be realized in a tight manner, and in particular in a gas-tight manner, in order to hold back possible foul gases which may be generated. So that an overpressure is not generated in this context in the liquid collecting tank, liquid collecting tank may be provided with a vent.

Should an overflow of the liquid collecting tank or of the wastewater shaft as a whole nevertheless ever be observed, an additional sump pump ensures that the wastewater shaft is able to be emptied by the same. Said sump pump is regularly placed in the already addressed space or installation area on the bottom surface of the wastewater shaft which is not covered by the liquid collecting tank.

Over and above this, the liquid collecting tank may be provided with at least one oblique surface for reducing deposits. Effectively, suspended matter, which can result in deposits in the interior of the liquid collecting tank, is still situated in the pretreated wastewater which is trapped and collected in the liquid collecting tank. Within the framework of the invention, said suspended matter is now guided along the oblique surface for reducing deposits as far as to the lowest point in the tank, from where it can be sucked up by the pump. In this case, said lowest point in the tank typically coincides with a suction region covered by the pump such that possible deposits can be conveyed directly into the pump intake, sucked in here by the pump and ultimately removed via the solids collecting tank. As a result, possible maintenance and cleaning work on the liquid collecting tank can be reduced to a minimum.

The design according to the invention of the liquid collecting tank as a closed space, with the bottom surface in the wastewater shaft only partially covered, provides over and above this the possibility of arranging the solids collecting tank as well as the optional pump and, where applicable, the distributor or the distributor casing (in each case) inside, partially inside or even outside the liquid collecting tank in the wastewater shaft. As a rule and for reasons of simple maintenance, the aforementioned components are typically placed outside the liquid collecting tank in order to keep them easily accessible. In principle, however, it is also possible to incorporate individual or all of the aforementioned components in part or also completely into the liquid collecting tank in order to implement a particularly compact design.

However, such a compact design is already made available according to the invention as a result of the basic structure because the liquid collecting tank and the wastewater shaft comprise at least one common wall surface. Said common wall surface can be a side wall surface and/or a bottom surface. In contrast, a common cover surface for the liquid collecting tank and the wastewater shaft is regularly not realized, although it is not excluded either within the framework of the invention.

In order to be able to implement this in detail, the common wall surface of the liquid collecting tank and of the wastewater shaft are realized according to an advantageous development of uniform material. That is to say, in this case the liquid collecting tank utilizes the common wall surface with the wastewater shaft and does not have its own wall in said region. Particular cost advantages are obtained as a result because the wall in question of the liquid collecting tank is unnecessary and consequently needs neither to be produced nor constructed.

As an alternative to this or in addition to it, the common wall surface of the liquid collecting tank and of the wastewater shaft can also consist of two materials which are joined together. In said case, the wall of the liquid collecting tank, on the one hand, and the wall of the wastewater shaft, on the other hand, are designed in each case so as to be independent of one another, but joined together. As a result, for example, the wall of the wastewater shaft can be additionally utilized to support the wall of the liquid collecting tank and to stabilize the same.

Finally, as a further alternative to this or also in addition to it within the framework of the invention, there is the option in the space for the common wall surface of the liquid collecting tank and that of the wastewater shaft to function as a lost mold. That is to say, in this case the wall of the liquid collecting tank, which at the same time provides the wall of the wastewater shaft, is typically utilized as a mold in the production of the liquid collecting tank or the corresponding wall is left out. For example, the liquid collecting tank may be a plastics material tank which is produced in an injection molding mold. The common wall surface with the wastewater shaft functions in this case as a lost mold. The said common wall surface therefore does not necessarily need to be taken into consideration in production.

Finally, it is recommended when the liquid collecting tank and the wastewater shaft are produced from concrete, metal, plastics material as well as combinations. In this case, in the region of the wall surface of the liquid collecting tank which is independent of the wastewater shaft, in each case a material that is different from the wastewater shaft is used. In the simplest case, the liquid collecting tank can be implemented and realized in such a manner in the interior of the wastewater shaft (produced from concrete) that an additional wall (produced from concrete) is drawn-into the wastewater shaft and is closed by way of a head-end cover which is produced, for example, from plastics material or metal. At any rate, the wastewater pumping station according to the invention is designed in a particularly compact and cost-efficient manner and provides advantages for maintenance and cleaning. These are the essential advantages.

Other objects, advantages and novel features of the present invention will become apparent from the following detailed description of one or more preferred embodiments when considered in conjunction with the accompanying drawings.

DETAILED DESCRIPTION

Figure 1:
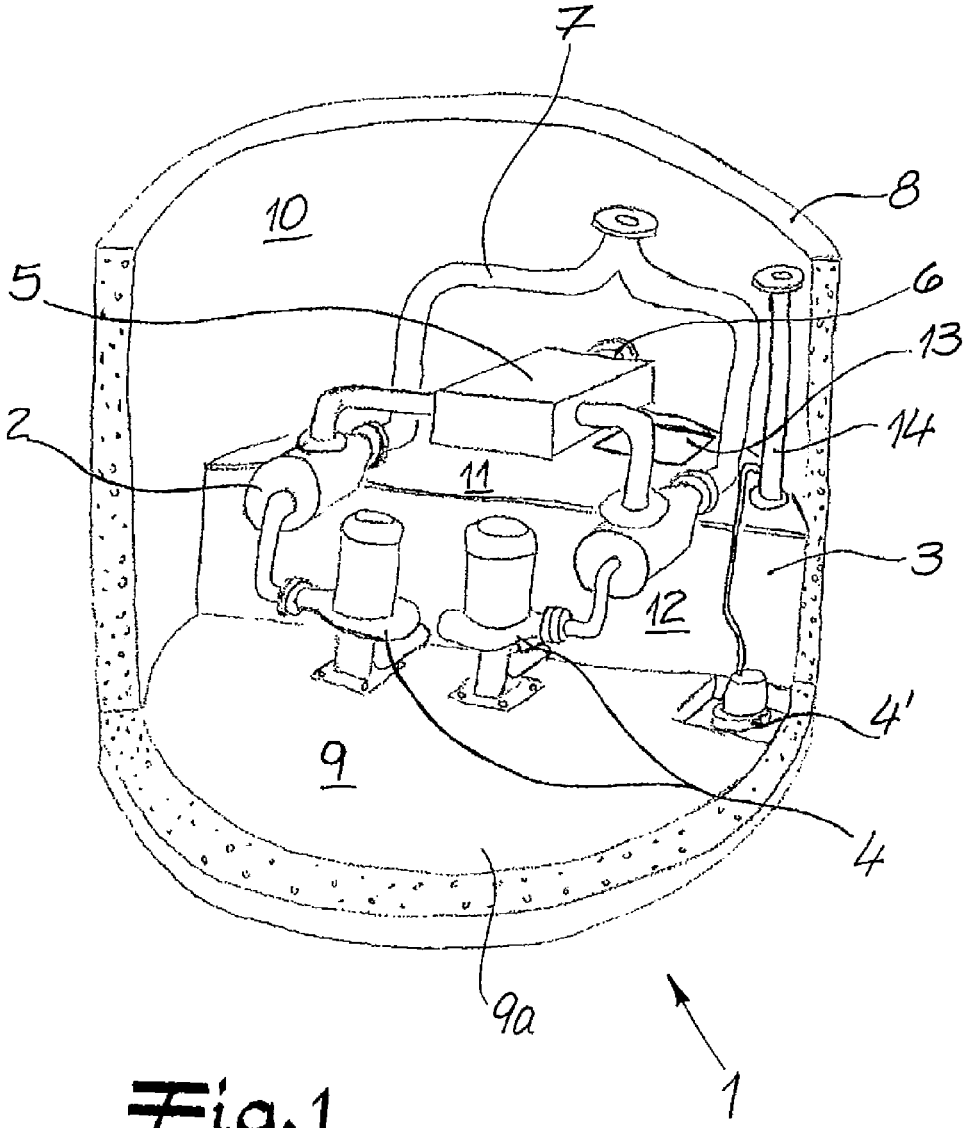
FIG. 1 shows a partial section of an overall view of the wastewater pumping station according to an embodiment of the invention.

The figures show a wastewater pumping station 1 which is received in a wastewater shaft 8. In its basic design, the wastewater pumping station 1 has a solids collecting tank 2 or, according to the exemplary embodiment in FIG. 1, two solids collecting tanks 2 and one liquid collecting tank 3. Over and above this, at least one pump 4 is also realized; the embodiment has two pumps 4.

A distributer or a distributor casing 5, by which inflowing wastewater which is loaded with solids is directed to the two solids collecting tanks 2, can additionally be seen. The distributor 5 is connected to an intake 6 for the wastewater for this purpose.

The wastewater, which is supplied by the distributor 5 and is loaded with solids, is pretreated by the two solids collecting tanks 2. Screens or the like are provided in the solids collecting tank 2 in question for this purpose. It is also possible for the distributor 5 to be provided with a type of screen, in the present case a rake for coarse solids in the wastewater, which is, however, not mandatory. The pretreated wastewater which has been rid of the solids then passes, following the solids collecting tank 2, into the liquid collecting tank 3 for the pretreated wastewater.

In the case of said operation, the pretreated wastewater flows against the conveying direction through the respective pump 4 and then into the liquid collecting tank 3. In this connection, a swing check valve (not shown) fits in or on the solids collecting tank 2 such that possible intake of wastewater from the distributor 5 is ruled out. In the present case, the pumps 4 operate in alternate mode in order, in this context, to enable unobstructed intake to the liquid collecting tank 3.

As soon as the liquid level in the liquid collecting tank 3 has reached or exceeded a certain level, in each case one of the pumps 4 is put into operation. The pump 4 then sucks the pretreated wastewater out of the liquid collecting tank 3 and transfers it into the associated solids collecting tank 2. As a result of said flow process, the addressed swing check valve is closed and the solids, which were previously held back in the solids collecting tank 2, are pumped with the wastewater and removed. A pressure pipe 7 is available on the output side for this purpose. Further details concerning the method of operation are described in European patent document no. EP 1 108 822 A1 which has already been referred to in the introduction.

Of particular inventive significance then is the fact that the liquid collecting tank 3 is realized as a fixed component part of a wastewater shaft 8. Effectively, the wastewater shaft 8 serves for receiving the solids collecting tank or the two solids collecting tanks 2 and also the liquid collecting tank 3. Over and above this, in the embodiment the already described distributor 5 as well as the two pumps 4 are also received in the interior of the wastewater shaft 8. In this case, the design overall is such that the liquid collecting tank 3 and the wastewater shaft 8 comprise at least one common wall surface 9, 10.

The common wall surface 9, 10 between, on the one hand, the wastewater shaft 8 and, on the other hand, the liquid collecting tank 3 is, within the framework of the embodiments shown, a bottom surface 9 and a side wall surface 10. The bottom surface 9 and the side wall surface 10—just as the entire wastewater shaft 8—are produced from concrete. In addition, the design is such that the liquid collecting tank 3 defines a closed chamber in the wastewater shaft 8. Over and above this, the liquid collecting tank 3 only partially covers the bottom surface 9 in question in the wastewater shaft 8, as is shown in particular by the sectional representations in FIGS. 2 to 4.

It can be seen that the bottom surface 9 in the wastewater shaft 8 is divided into two with a part bottom surface 9*a* which is not covered by the liquid collecting tank 3 and a further part bottom surface 9*b* which is associated with the liquid collecting tank 3 or is covered by said liquid collecting tank. The part bottom surface 9*a*, which is free of the collecting tank 3 or is not covered, defines a space or installation area. In the embodiment, the two pumps 4 are arranged on the floor of the wastewater shaft 8 in said space or installation area above the part bottom surface 9*a*. Over and above this, the two solids collecting tanks 2 and also the distributor 5 are situated in the relevant space which extends additionally above a removable cover 11 of the liquid collecting tank 3. Effectively, the liquid collecting tank 3 has not only the already addressed common wall surface 9, 10 with the wastewater shaft 8, but, over and above this, is also provided with independent wall surfaces 11 or 11, 12 of the wastewater shaft 8.

Said independent wall surfaces 11, 12 are, on the one hand, the already addressed removable, head-end cover 11 for the liquid collecting tank 3 and, on the other hand, one or several side walls 12. Within the framework of the embodiment according to FIG. 2, the side wall 12 at that location is directly defined in the wastewater shaft 8 and, for example as the wastewater shaft 8, may be produced as a whole from uniform material, concrete, in order to provide a particularly durable and pressure-resistant structure. Here, only the wall surface 11 or cover 11 is independent of the wastewater shaft 8 and is produced from metal, that is to say of a different material.

Figure 3:
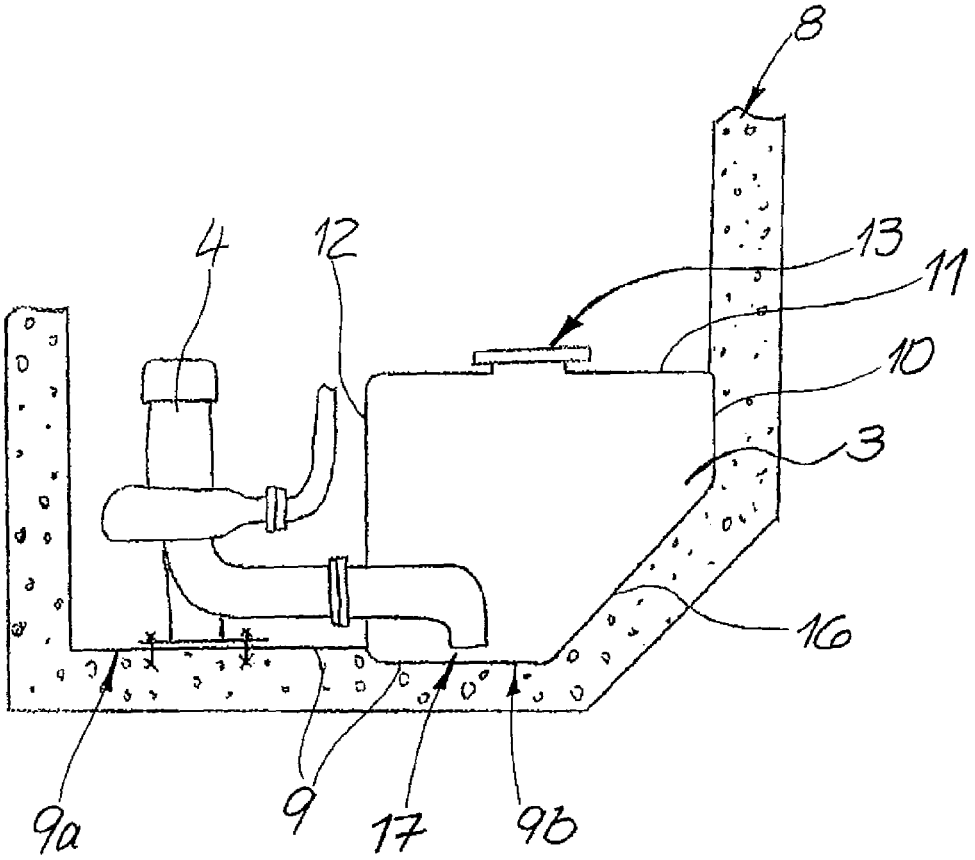
Figure 4:
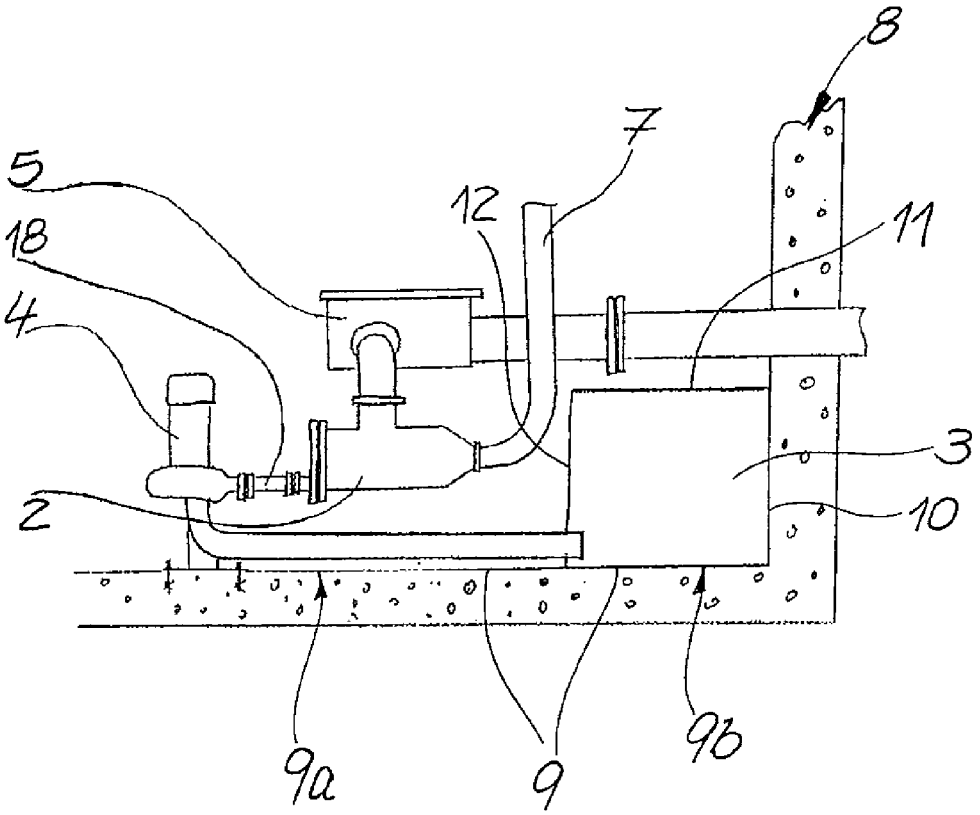
FIG. 4 shows a further modification with a liquid collecting tank indicated.

In the case of the variant according to FIG. 3 and also within the framework of FIG. 4, the wall surfaces 11, 12, which are independent of the wastewater shaft 8, provide component parts of the liquid collecting tank 3 which is inserted and is insertable into the wastewater shaft 8 and is produced from plastics material. In this case, the wastewater shaft 8 may function, so to speak, as a lost mold. That is to say, to define the liquid collecting tank 3 in the interior of the wastewater shaft 8, it is simply necessary to produce the removable cover 11 in conjunction with the side walls 12 externally and to utilize the common wall surfaces 9, 10 of the wastewater shaft 8. In this case, the liquid collecting tank 3 is designed in an open manner and utilizes the common wall surface 9, 10 as a lost mold or for its completion so that overall a closed design of the liquid collecting tank 3 is realized.

Figure 2:
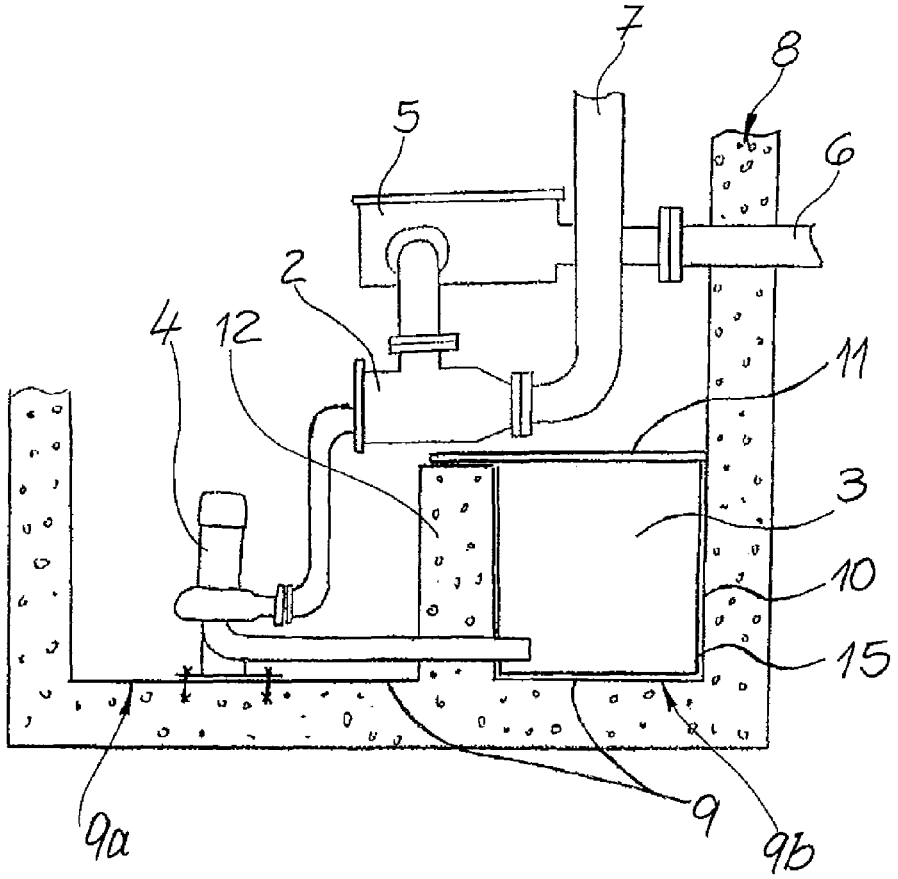
FIG. 2 shows a section through the object according to FIG. 1, FIG. 3 also shows a section through a variant of a wastewater pumping station according to an embodiment of the invention

The common wall surface 9, 10 of the liquid collecting tank 3 and of the wastewater shaft 8 can be realized from uniform material, as is shown within the framework of the variant according to FIGS. 2 and 3. In this case, the wall surface 9, 10 of the wastewater shaft 8 (produced from concrete) functions at the same time as wall surface 9, 10 for the liquid collecting tank 3, the remaining wall surfaces of which 11, 12 are produced or can be produced from plastics material or metal or also combinations.

In the case of the variant according to FIG. 4, the common wall surface 9, 10 of the wastewater shaft 8 and that of the liquid collecting tank 3 are produced from two materials that have been joined together. In this case, the wastewater shaft 8 functions as a support or reinforcement for the separately present wall surfaces 9, 10 of the liquid collecting tank 3.

By way of the variant in FIG. 3, it can be seen that the, where applicable, removable head-end cover 11 of the liquid collecting tank 3 can be provided with an inspection opening 13. The liquid collecting tank 3 can be checked and, where applicable, cleaned via said inspection opening 13. As a further option, another vent 14 for the liquid collecting tank 3 is shown in FIG. 1 next to the inspection opening 13. Said vent 14 ensures that a possible overpressure in the liquid collecting tank 3 is avoided.

Effectively, the liquid collecting tank 3 within the framework of the embodiment is designed in a tight manner and in particular in a gas-tight manner such that possible foul gases generated in the interior have to be removed. The vent 14 is used for this purpose.

FIG. 1 also shows one more pump 4' which, in the present case, is designed as a sump pump and serves for the purpose of pumping out possible liquid that has accumulated in the wastewater shaft 8 in the event of flooding and removing it out of the wastewater shaft 8.

The possibility of providing the liquid collecting tank 3 with an inside coating 15 is also shown within the framework of the variant according to FIG. 2. Said coating 15 is situated, in the present case, in the region of the wall surfaces or walls 9, 10, 12 which, in the case of said embodiment, are each produced from concrete. The coating 15 in question, which can be designed, for example, as a plastics material coating, is provided so that no liquid is able to escape out of the liquid collecting tank 3 through the concrete.

Within the framework of the variant according to FIG. 3, it is possible to see an oblique surface 16 as a component part of the liquid collecting tank 3. By said oblique surface 16, deposits are prevented from being able to build up in the interior of the liquid collecting tank. To this end, the oblique surface 16 in question is arranged such that the deposits are conveyed along the oblique surface 16 as far as into an intake 17 for the pump 4, from where they are sucked up by the pump 4 and are ultimately removed by means of the pressure pipe 7.

Finally, the exemplary embodiment according to FIG. 4 shows yet another variant in such a manner that a floor of the solids collecting tank 2 and a pressure pipe 18 of the pump 4 are arranged at approximately the same height. In this embodiment, the pressure pipe 18 is an intermediate piece between the pump 4 and the solids collecting tank 2. In all cases, the arrangement of the pressure pipe 18 of the pump 4 and of the solids collecting tank 2 at approximately the same level results overall in the solids, which have been held back in the solids collecting tank 2, being detached in a particularly efficient manner by a separating screen, which in the majority of cases is provided there, when the pump 4 sucks up the pretreated wastewater from the liquid collecting tank 3 and conveys it via the solids collecting tank 2, together with the solids which were held back there, into the pressure pipe 7. The variant according to FIG. 4 is also characterized in that a particularly low installation height is seen and the design of the wastewater pumping station according to the invention is not only compact but is also linked to a shallow depth or shaft height of the wastewater shaft 8.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A wastewater pumping station, comprising:

at least one solids collecting tank configured to receive wastewater containing solids;

a liquid collecting tank configured to receive the wastewater after removal of the solids in the at least one solids collecting tank;

a wastewater shaft configured to contain the at least the solids collecting tank and the liquid collecting tank, wherein the liquid collecting tank and the wastewater shaft share a common portion of the wastewater shaft floor surface and have at least one common side wall surface, the liquid collecting tank has at least one wall surface which is not common with and is formed from a different material than the wastewater shaft, and the liquid collecting tank is a closed chamber in the wastewater shaft only partially covering a bottom area of the wastewater shaft.

2. The wastewater pumping station as claimed in claim 1, wherein the common wall surface of the liquid collecting tank and the wastewater shaft is at least one of formed from uniform material and formed from two joined-together materials configured as a lost mold.

3. The wastewater pumping station as claimed in claim 2, wherein the liquid collecting tank and the wastewater shaft are formed from at least one of concrete, metal and plastics material.

4. The wastewater pumping station as claimed in claim 1, wherein the liquid collecting tank includes a removable cover.

5. The wastewater pumping station as claimed in claim 1, wherein the liquid collecting tank includes an inspection opening.

6. The wastewater pumping station as claimed in claim 1, wherein at least one of the wastewater shaft and the liquid collecting tank includes a coating.

7. The wastewater pumping station as claimed in claim 1, wherein the liquid collecting tank is gas-tight.

8. The wastewater pumping station as claimed in claim 7, wherein the liquid collecting tank includes a vent.

9. The wastewater pumping station as claimed in claim 1, wherein the liquid collecting tank includes at least one oblique surface configured to direct deposits to a deposit collection region.

10. The wastewater pumping station as claimed in claim 1, further comprising:

at least one of a pump and a distributor configured to transfer the wastewater out of the wastewater shaft, wherein the solids collecting tank, the at least one of the pump and the distributor are arranged in the wastewater shaft at least one of inside, partially inside and outside the liquid collecting tank.

* * * * *